United States Patent [19]

Martin

[11] Patent Number: 5,003,888

[45] Date of Patent: Apr. 2, 1991

[54] RAIL FASTENER APPLICATOR

[75] Inventor: Richard W. Martin, Sturt, Australia

[73] Assignee: McKay Australia Limited, Maidstone, Australia

[21] Appl. No.: 394,632

[22] Filed: Aug. 16, 1989

[30] Foreign Application Priority Data

Oct. 13, 1988 [AU] Australia ..... PJ0937

[51] Int. Cl.[5] ..... E01B 29/32; B61H 13/00

[52] U.S. Cl. ..... 104/17.002; 188/57

[58] Field of Search ..... 104/1 R, 9, 16, 17.2, 104/2; 238/321, 349, 351; 188/5, 7, 29, 57, 74; 29/243.5, 243.56

[56] References Cited

U.S. PATENT DOCUMENTS

| | | | |
|---|---|---|---|
| 675,405 | 6/1901 | Paul et al. | 188/7.2 |
| 1,734,882 | 11/1929 | Sayers | 188/7.2 |
| 2,853,732 | 2/1958 | Matter | 188/74 |
| 3,103,754 | 9/1963 | Wieger | 188/29 |
| 3,127,847 | 4/1964 | Sivon | 104/17.2 |
| 4,068,593 | 1/1978 | Leeves | 104/17.2 |
| 4,367,682 | 1/1983 | Freilich et al. | 104/17.2 |
| 4,494,463 | 1/1985 | Young et al. | 104/17.2 |
| 4,903,611 | 2/1990 | Holley | 104/172.2 |

FOREIGN PATENT DOCUMENTS

| | | | |
|---|---|---|---|
| 0964116 | 3/1975 | Canada | 104/17.2 |

*Primary Examiner*—Robert J. Oberleitner
*Assistant Examiner*—Mark T. Le
*Attorney, Agent, or Firm*—Edwin T. Bean, Jr.; Martin G. Linihan; John C. Thompson

[57] ABSTRACT

An applicator for applying two rail fasteners at right angle to a rail. The applicator incorporates a pair of applicator arms pivoted midway between their ends and having an hydraulic ram connected between their upper ends. This enables the abutment faces on the lower ends of the applicator arms to be moved in unison toward the rail fasteners or away from them. The applicator also incorporates a brake mechanism which contacts the wheel of the applicator which rides the rail. This brake mechanism is adjustable to adjust the height of the applicator arms above the rail tie so that when the applicator is stopped the applicator abutment faces are at the correct height.

4 Claims, 3 Drawing Sheets

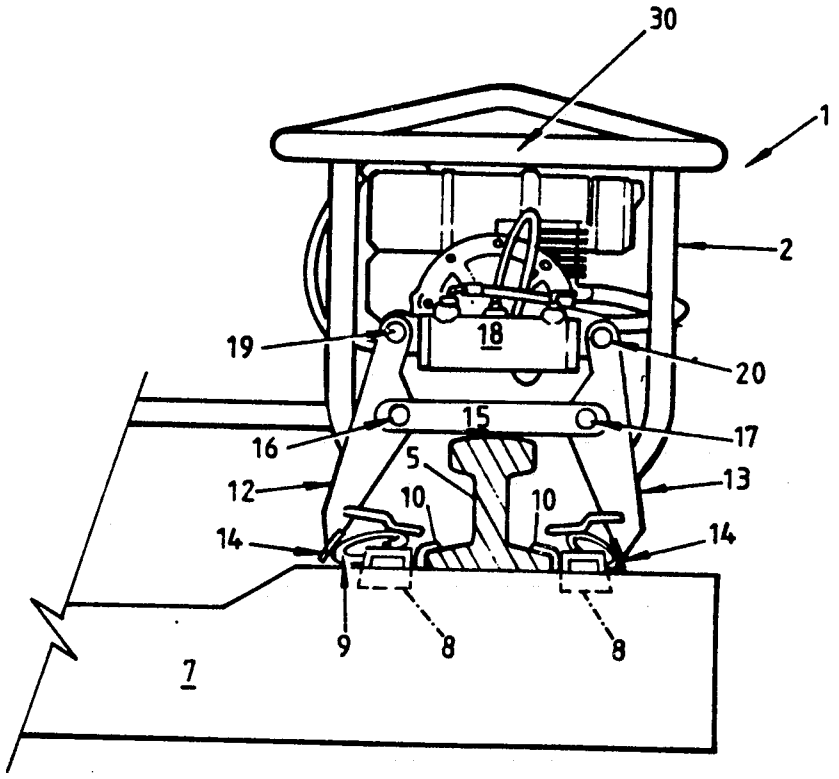
Fig. 1
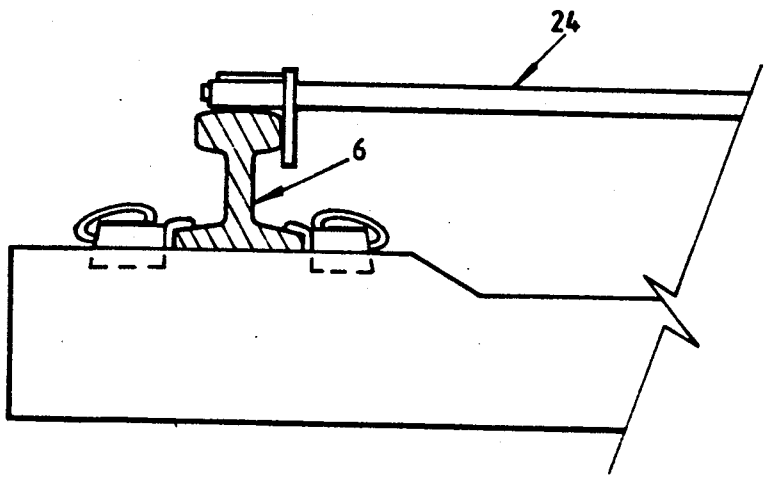

RAIL FASTENER APPLICATOR

BACKGROUND OF THE INVENTION

This invention relates to improvements in rail fastener applicators.

In particular it applies to applicators applying fasteners at right angles to the rail. An applicator of this type is described in U.S Pat. No. 4,484,463 (equivalent to AU 548030) That applicator was particularly useful in laying new rail and applied four fasteners to two rails at a time.

This invention is concerned with a smaller applicator for use on a single rail Such an applicator needs to be manually moveable by an operator and to be reasonably compact and light.

SUMMARY OF THE INVENTION

To this end the present invention in one aspect provides a rail fastener applicator for use with rail fasteners which are applied horizontally in a direction at right angles to the longitudinal dimensions of the rail comprising:

a carrier frame mounted for movement along a rail; a pair of opposed applicator arms pivoted intermediate their ends at spaced positions spanning said rail;

each applicator arm having an abutment face adjacent its lower end adapted to contact a rail fastener; and means connected to the upper end of each applicator arm adapted to move said pair of applicator arms in unison either away from each other or toward each other.

This arrangement differs from the arrangement of U.S. Pat. No. 4,494,463 where the arms had a common pivot point at their upper ends and the hydraulic means moving the arms in unison was located intermediate the ends of the arms. In the present invention the arrangement of the arms provides a more compact and lighter construction.

In another aspect of this invention there is provided a rail applicator comprising a frame with wheels mounted for movement along a rail, said frame being rotatable in a vertical plane about a pivot point from a position in which the applicator can be moved along the rail so that the fastener applicator arms are clear of the rail to a position where the applicator arms are contactable with the fasteners to apply the rail fasteners to the rail, and dual height adjustment and brake means attached to said frame and adapted to engage the wheels or the rail when said frame is in the fastener application position.

This arrangement provides a unique solution to the problem encountered in a light weight machine of adjusting the height of the applicator arms to accommodate varying rail sizes and to provide a means of holding the applicator frame in position during the operation of applying the fasteners to the rail.

It is preferred that the applicator of this invention includes an hydraulic power circuit for moving the applicator arms. By locating this appropriately on the frame in relation to the pivoting point of the frame, it is relatively easy for an operator to tilt the frame up while pushing the applicator along the rail and to lower the frame to engage the brake onto the wheel or the rail to hold the applicator in position with the applicator arms at the correct height.

BRIEF DESCRIPTION OF THE DRAWING

A preferred embodiment of this invention will now be described in relation to the drawings in which FIG. 1 is a view from the operator's end of the applicator and rail

DESCRIPTION OF THE PREFERRED EMBODIMENTS

Figure 2:
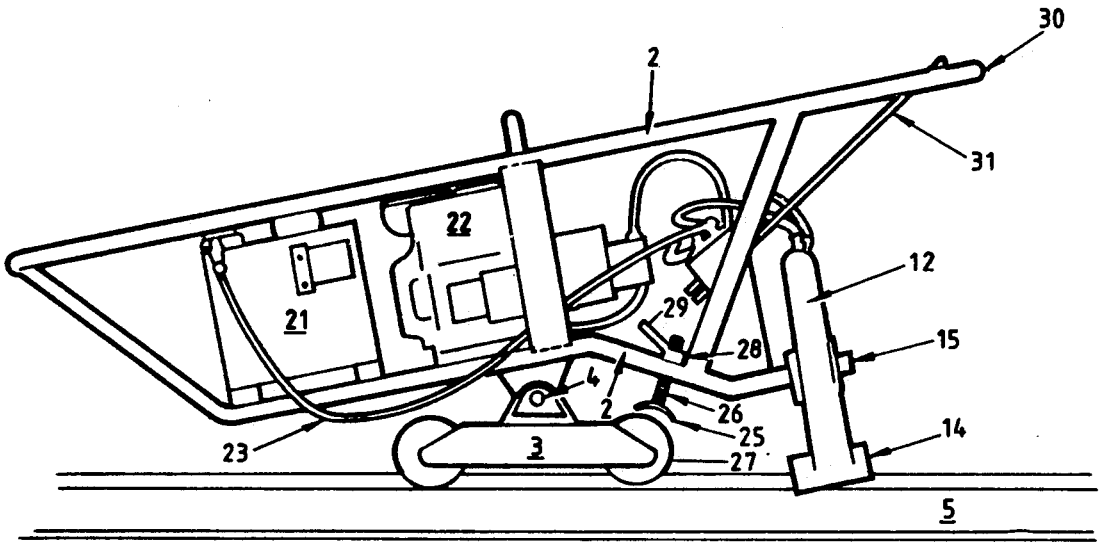
FIG. 2 is a side view of the applicator on the up position.

The rail applicator 1 comprises a frame 2 mounted on a wheeled bogie 3 and pivoted about point 4 for vertical movement. Pivot point 4 is part of a yoke which is pivoted axis the wheeled bogie 3 This permits the frame 2 to be rotatable through 180° to allow the machine to be worked in the opposite direction of travel.

The wheels are mounted on the rail 5 and the whole is stabilized by the arm 24 which extends across to the second rail 6. The stabilizer arm 24 is socketed into bogie 3 and is rotatable to permit the applicator to be tilted from the vertical to cater for different angles of rail tilt.

The rail fastener system which holds the rail 5 to the rail tie 7 is preferably of the kind described in Australian Patent Application Nos. 37379/78, 47/881/79, 54004/79 and 60581/79. The support shoulders 8 are embedded in the concrete rail tie 7 Rail fasteners 9 are located in the shoulders 8 prior to being pushed on to the flange of rail 5 (FIG. 1). The insulators 10 are shown lying between the flange of rail 5 and the shoulders 8 The fasteners 9 when applied lie on the insulators 10 to bear down on the rail flange and hold the rail 5 in position.

The applicator 1 includes a pair of applicator arms 12 and 13 each carrying an abutment face 14 at their lower end. The arms 12 and 13 are pivoted at points 16 and 17 on the cross piece 15 which is mounted on the frame 2.

An hydraulic ram 18 is mounted between the upper ends of the applicator arms 12 and 13 and attached to them at points 19 and 20. The arms 12 and 13 thus move in unison to apply the fasteners 9 simultaneously.

The hydraulic control valves 21 of the hydraulic pump 22 are connected by a series of lines 23 to each other and the ram 18. Location of the controls 21 and the pump 22 is selected to provide easy movement of the frame 2 about the pivot 4 to and from the positions shown in FIGS. 2 and 3. The controls 21 and pump 22 and the ram 18 are all conventional.

The brake and height adjustment mechanism comprises a brake pad 25 secured to a bolt 26 mounted in the frame 2 adjacent one of the wheels 27 of bogey 3. The threaded nut 28 with its attached lever 29 enables the length of the bolt 26 extending below frame 2 to be adjusted with the consequential result of adjusting the height of the frame 2 and the applicator faces 14 relative to the rail 5.

Figure 3:
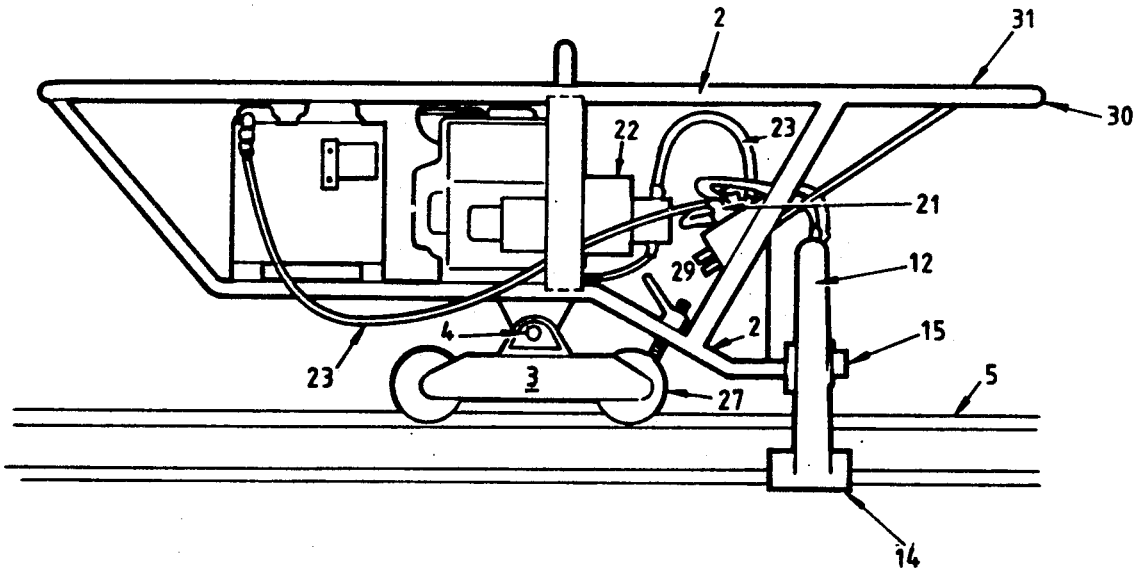
FIG. 3 is a side view in the down position and FIG. 4 is a detailed view of the height adjuster brake.
Figure 4:
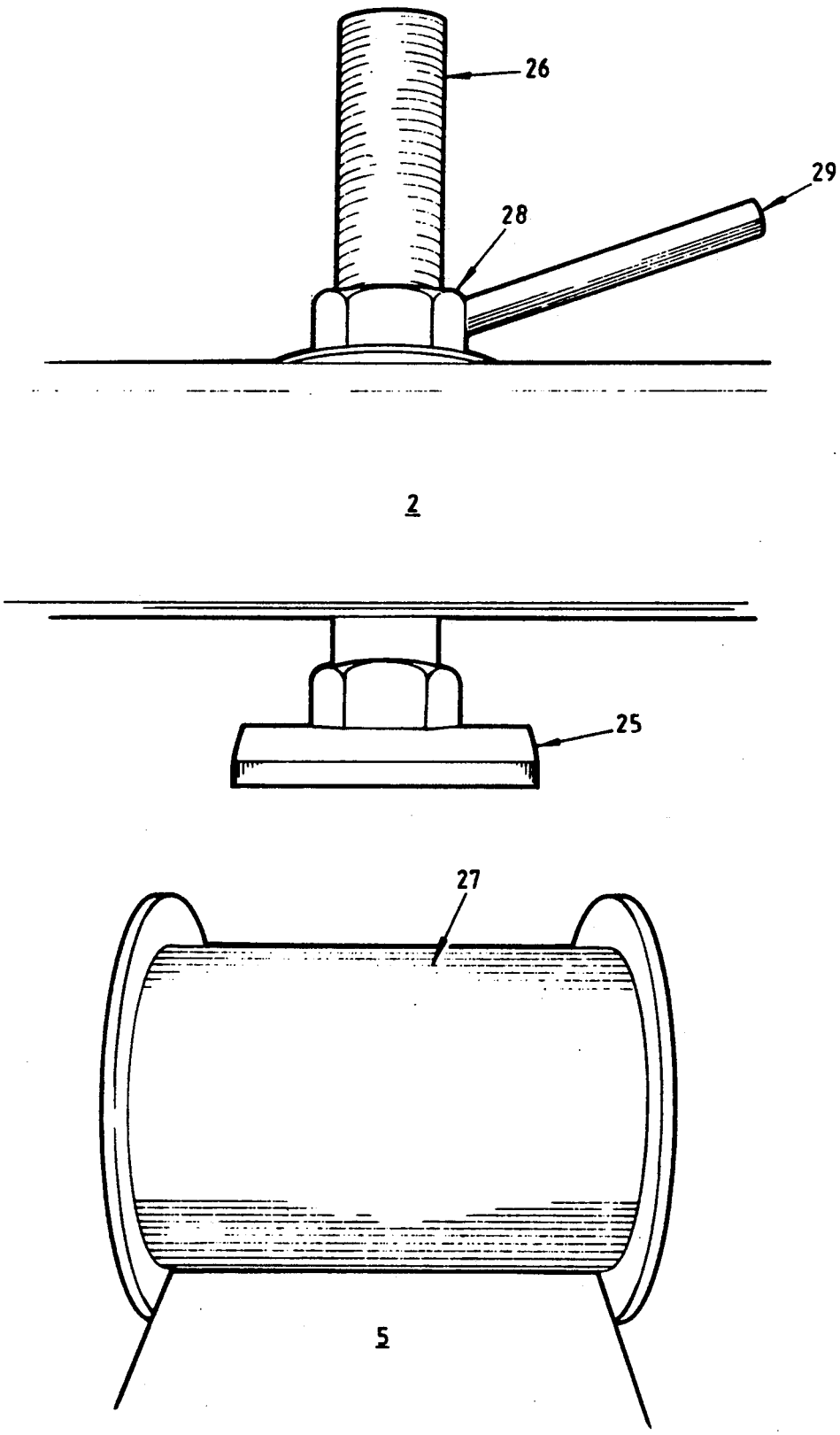

In operation the operator holds the handle bar portion 30 of frame 2 and pushes the applicator along the rail to the next rail seat By lowering the frame to the position of FIG. 3 the brake pad 25 engages wheel 27 and stops further movement of the applicator.

The abutment faces 14 are now located in position and operation of the control lever 31 actuates the hydraulic mechanism and ram 18 to move the arms 12 and 13 in unison so that the abutment faces 14 push the fasteners 9 onto the flange of rail 5.

The applicator of this invention can be used to fasten rails in either track laying or repair work.

From the above it can be seen that this invention does provide a simple and compact fastener applicator.

I claim:

1. A rail fastener applicator for use with rail fasteners which are applied horizontally in a direction at right angles to the longitudinal dimension of a rail comprising:

a carrier frame mounted for movement along a rail; a pair of opposed applicator arms spanning said rail and pivoted intermediate their ends at spaced positions about axes substantially parallel to the longitudinal dimensions of the rail;

each applicator arm having an abutment face adjacent its lower end adapted to contact a rail fastener;

means connected to the upper end of each applicator arm adapted to move said pair of applicator arms in unison either away from each other or toward each other; and means for pivoting said carrier frame about a horizontal axis at right angles to the rail to enable the abutment faces on the applicator arms to be raised clear of said rail.

2. An applicator as claimed in claim 1, wherein said carrier frame includes a crossbar spanning the rail and having adjacent each end a pivot point on which each applicator arm is mounted and an hydraulic or pneumatic ram is connected between the upper ends of said pair of opposed applicator arms.

3. An applicator as claimed in claim 1, which incorporates a brake element for engaging with one of the rail wheels on said carrier frame, said element allowing adjustment of the height of the abutment faces relative to the rail.

4. A rail fastener applicator comprising a frame with wheels mounted for movement along a rail and fastener applicator arms, said frame being rotatable on said wheels in a vertical plane about a pivot point from a position in which the applicator is moved along the rail so that the fastener applicator arms are clear of the rail to a position where the applicator arms contact the fasteners to apply the rail fasteners to the rail, and a single mechanism serving as a dual height adjustment and brake means attached to said frame for engaging the wheels when said frame is in the fastener application position.

* * * * *